US008408487B2

(12) United States Patent
Rodrian et al.

(10) Patent No.: US 8,408,487 B2
(45) Date of Patent: Apr. 2, 2013

(54) ROLLED MATERIAL DISPENSER WITH ENERGY HARVESTING

(76) Inventors: Jeffrey E. Rodrian, Grafton, WI (US); James A. Rodrian, Grafton, WI (US)

( * ) Notice: Subject to any disclaimer, the term of this patent is extended or adjusted under 35 U.S.C. 154(b) by 870 days.

(21) Appl. No.: 12/551,094

(22) Filed: Aug. 31, 2009

(65) Prior Publication Data

US 2010/0051737 A1 Mar. 4, 2010

Related U.S. Application Data

(60) Provisional application No. 61/094,236, filed on Sep. 4, 2008.

(51) Int. Cl.
*B65H 20/02* (2006.01)

(52) U.S. Cl. ..... 242/564.4; 242/563; 242/565

(58) Field of Classification Search ..... 242/563, 242/564, 564.1, 564.3, 564.4, 565, 390, 390.1, 242/390.2, 390.8; 226/127, 188
See application file for complete search history.

(56) References Cited

U.S. PATENT DOCUMENTS

| | | | | |
|---|---|---|---|---|
| 4,666,099 | A | 5/1987 | Hoffman et al. | |
| 4,786,005 | A * | 11/1988 | Hoffman et al. | 242/564.1 |
| 4,960,248 | A | 10/1990 | Bauer et al. | |
| 5,772,291 | A | 6/1998 | Byrd et al. | |
| 6,105,898 | A | 8/2000 | Byrd et al. | |
| 6,293,486 | B1 | 9/2001 | Byrd et al. | |
| 6,695,246 | B1 | 2/2004 | Elliott et al. | |
| 7,213,782 | B2 | 5/2007 | Osborne et al. | |
| 2005/0145745 | A1 * | 7/2005 | Lewis et al. | 242/563 |
| 2006/0076913 | A1 | 4/2006 | Rodrian | |
| 2010/0170979 | A1 * | 7/2010 | Lewis et al. | 242/563.2 |

* cited by examiner

*Primary Examiner* — William A Rivera
(74) *Attorney, Agent, or Firm* — Quarles & Brady LLP; George E. Haas

(57) ABSTRACT

An automatic dispenser for a rolled material has a sensor that detects the presence of a user in front of the dispenser. When that occurs, a motor is driven by energy stored in a battery or a capacitor and a short length of the material is dispensed from the roll. The user then grasps that short length and pulls more of the material off the roll, thereby causing the roll to rotate. Rotation of the roll drives the motor as a generator producing electrical energy that recharges the battery or capacitor.

14 Claims, 4 Drawing Sheets

ROLLED MATERIAL DISPENSER WITH ENERGY HARVESTING

CROSS-REFERENCE TO RELATED APPLICATIONS

This application claims benefit of U.S. Provisional Patent Application No. 61/094,236 filed on Sep. 4, 2008.

STATEMENT REGARDING FEDERALLY SPONSORED RESEARCH OR DEVELOPMENT

Not Applicable

BACKGROUND OF THE INVENTION

1. Field of the Invention

The present invention relates to dispensers for material that is supplied in roll form, such as paper towels; and more particularly to such dispensers that are electrically operated.

2. Description of the Related Art

Various devices have been created to dispense materials that are provided on rolls, such as paper towels. The roll is placed on a mechanism in the dispenser that is driven by an electric motor. A sensor, such as an infrared proximity detector, is often employed to determine when the hands of a user are near an outlet opening of the dispenser. When the sensor detects a user's hands, the electric motor is activated to drive the roll for a specified period of time, thereby unrolling a given quantity of the material through the dispenser outlet opening and into the hands of the user. When the unrolling terminates, the user tears off the dispensed quantity of the material.

Power for operating the motor is derived either from batteries inside the dispenser or by a connection to the electrical system of the building in which the dispenser is located. Using the building's electrical system has the advantage of a generally reliable and constant power supply. However, it may be undesirable to provide an external electrical connection to the building wiring for dispensers placed into an area where water is present, thereby creating a potential shock hazard. Further a connection to the building's electrical system may not be available at the desired location for a dispenser. For those locations a battery powered dispenser is preferred, however over time batteries become depleted and the dispenser does not operate until the batteries are replaced. Frequently replacing batteries adds expense to the operation of the dispenser.

DETAILED DESCRIPTION OF THE INVENTION

Figure 1:
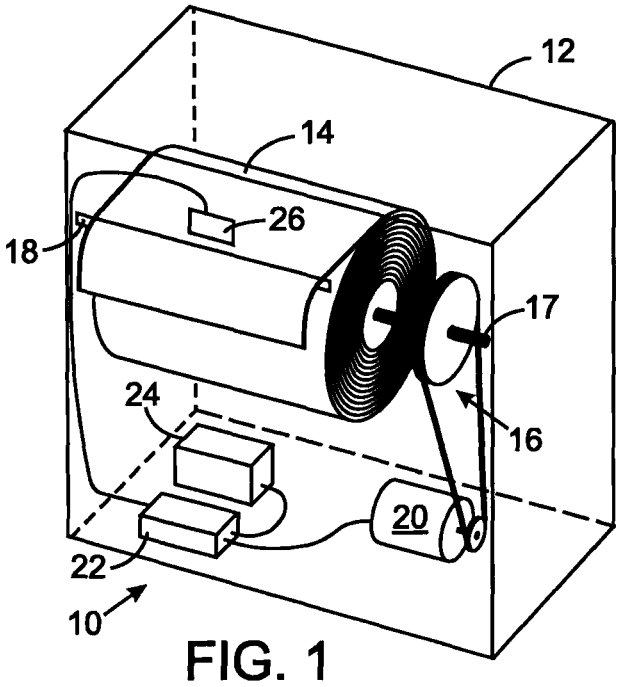
FIG. 1 illustrates a dispenser for material on a roll, according to the present invention.
Figure 3:
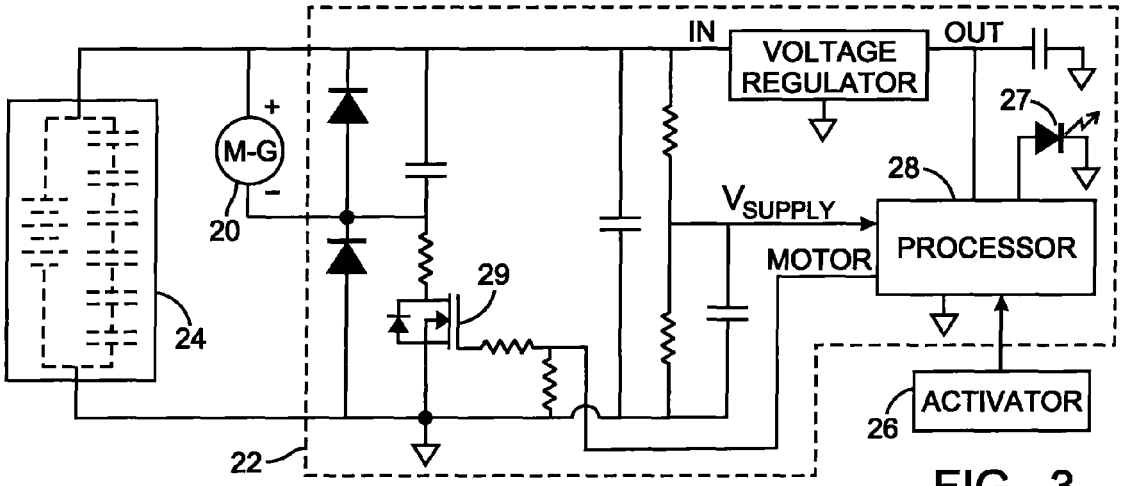
FIG. 3 is a schematic diagram of the electrical circuit for the dispenser.

The initial reference to FIG. 1, a dispenser 10 has a housing 12 that contains a material, e.g. paper towels, that is provided on a roll 14. The roll 14 is rotationally mounted on a support 17, such as a shaft, that is coupled to a driver 16. For example, driver 16 can be a shaft, belt and pulley arrangement that rotates the roll to feed the material through an outlet 18 in the form of a slot in the housing 12. The driver 16 is operated by a direct current (DC) electric motor 20 that is operated by a controller 22. The controller 22 preferably contains a programmable processor, such as a microcomputer, however a hard-wired circuit can be used. The controller 22 and the motor 20 receive energy from a power storage device 24, that may be a battery or one or more high capacity capacitors. An example of the electrical circuit for the controller 22 is shown in FIG. 3 in which the processor 28, receives an input signal $V_{SUPPLY}$ that is detected by a voltage sensor within the processor to provide an indication of the amount of energy stored in the power storage device 24. The processor 28 produces an output signal MOTOR that operates a transistor switch 29 which activates the motor 20. Note that the circuit diagram depicts the power storage device 24 in phantom lines as either a rechargeable battery or a series of capacitors.

An activator 26, connected to the controller 22, is located on the housing 12 adjacent the outlet 18 to trigger material dispensing. The activator 26 simply may be a switch that is manually operated by a user who desires to receive a length of the material from the dispenser 10. In other embodiments, the activator 26 is a sensor which detects the presence of a user adjacent the dispenser 10. For example, the activator 26 may be an infrared sensor similar to those used to automatically operate faucets in a public restroom. Such devices emit a beam of infrared light which, when reflected by the user's hand adjacent the housing outlet 18, is sensed by a light detector. Sensing reflected light causes the activator 26 to produce an output signal indicating the presence of a user to the controller 22. Ultrasonic and other types of user proximity sensors can be employed.

The controller 22 may govern the operation of the dispenser with a level of sophistication that minimizes power consumption in order to maximize the operating time before the battery, if used, requires replacement. In addition the present dispenser, provides a technique for harvesting energy produced when a user pulls a length of the rolled material from the dispenser. Pulling out the material rotates the roll 14 which mechanically drives the motor 20 due to the pulley and belt connection. This results in the motor 20 acting as an electrical generator, producing an electric current that is used to recharge the power storage device 24. As a consequence, the motor 20 also is referred to as a "motor-generator" (M-G).

Figure 2:
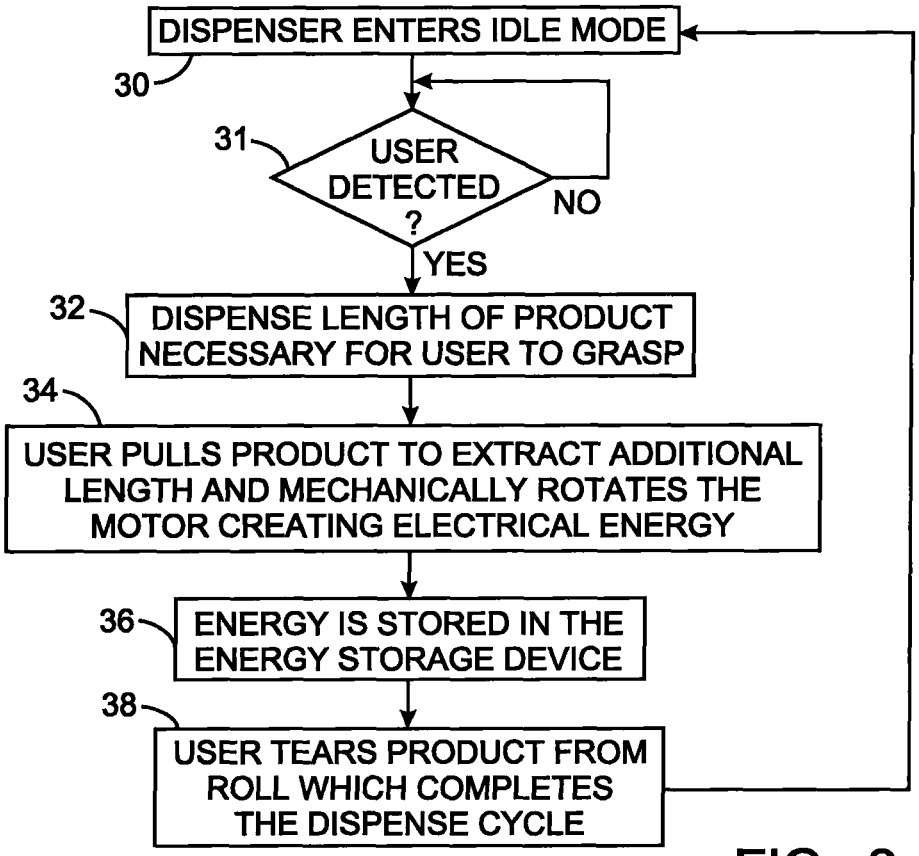
FIG. 2 is a flowchart of one version of a material dispensing cycle.

FIG. 2 depicts a flowchart of an exemplary material dispensing cycle. Most of the time, the dispenser 10 is in an idle mode at step 30, awaiting a signal from the activator 26 which indicates that dispensing of the material is desired. If a user proximity sensor is employed as the activator 26, the controller 22 periodically activates the sensor, for example, once every 100 milliseconds, in the idle mode. At step 31, when the controller receives a signal back from the activator 26 indicating presence of a user, the motor 20 is actuated for a brief period of time at step 32 to dispense a short length of the material that is sufficient to be grasped by a user's hands, as shown in FIG. 1. For example, two to three inches of a paper towel is sufficient for a user to grasp. With reference to FIG.

3, the processor 28 in the controller 22 responds to the active signal from the activator 26 by producing an active MOTOR signal which turns on transistor switch 29, thereby powering the motor 20 for the brief time period.

Then at step 34 in FIG. 2, the user grasps the projecting material and pulls a longer length from the dispenser 10 to extract a sufficient amount for use. The mechanism on which the roll 14 is mounted may mechanically or electro-mechanically limit the amount of the material that the user may pull out. The extraction of material by the user rotates the roll 14 which drives the motor 20. The motor, being driven by the roll at this time, acts as a generator producing an electric current that is conveyed to the storage device 24, which is thereby recharged at step 36. Note that the transistor switch 29 is turned off at this time. When the user tears off the extracted material, the dispensing cycle is complete at step 38, and the dispenser 10 once again enters the idle mode by returning to step 30.

Thus, only a relatively small amount of electric power is used to dispense a short piece of the material during each dispensing cycle. Action of the user pulling out a longer piece of the material generates electricity that is used to at least partially replenish the energy in the storage device 24.

It should be understood that the dispenser is consuming power in the idle mode, during which time the controller 22 is periodically activating the user sensor, i.e. activator 26. Therefore, operation in the idle mode for an extended period of time decreases the energy in the storage device 24 and may result in insufficient energy being available when it comes time to dispense the material. Thus, an enhanced version of the dispenser detects a low energy condition and in response dispenses of the small amount of the material even though a user is not present. Thus by the time that energy in the storage device depletes further to an insufficient level to operate the motor, a short length of the material already projects from the dispenser 10. That small amount of material enables the next user to extract the material and recharge the energy storage device 24.

Figure 4:
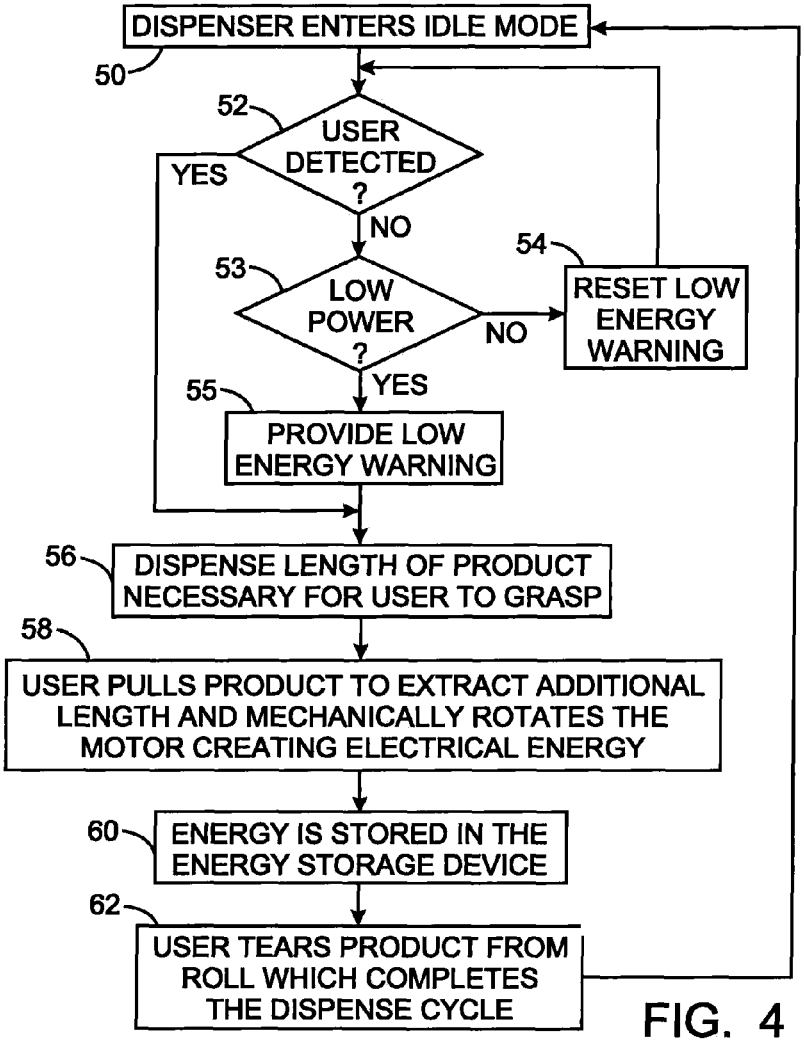
FIG. 4 is a flowchart depicting operation of a dispenser which includes low supply energy monitoring.

FIG. 4 shows a flowchart of operation of this enhanced dispenser. The dispenser enters the idle mode at step 50 during which the controller 22 periodically activates the proximity sensor type activator 26 at step 52 to detect whether a user is present.

In the absence of a user, the operation advances to step 53 where a determination is made whether the storage device 24 is at a lower energy level. The low energy condition can be determined by any of several techniques. One is the occurrence of a predefined amount of time since the previous dispensing operation. In another technique used in FIG. 3, the controller 22 monitors the voltage $V_{SUPPLY}$ from the storage device 24 to determine when that voltage drops below a given level, this indicates the amount of energy stored in that device. A further technique involves the controller 22 measuring the amount of power required to dispense the material during a dispensing cycle or computing a running average of that power requirement over several dispensing operations. If sufficient energy exists in the storage device 24, any previous low energy warning is cleared at step 54 before the operation returns to the idle mode at step 50.

When the energy level of the storage device 24 decreases near the minimum amount required to dispense the material, a low energy warning is issued at step 55, such as by illuminating an indicator light emitting diode 27. Then the operation advances to step 56 where a short length of the material is dispensed to provide a sufficient amount for a subsequent user to grasp. Specifically, the controller 22 activates the motor 20 for a short period of time to unwind the roll 14 and to dispense two to three inches of material through the outlet 18 in the housing. Thus, when the storage device 24 is at a low energy state, the dispenser provides a length of towel for the next user.

Eventually when a user approaches the dispenser 10 and finds a portion of the material projecting therefrom, the person at step 58 grasps that portion and pulls an additional amount out of the dispenser to provide a sufficient length of towel for use. This extraction of the towel rotates the roll 14 which drives the motor 20 as a generator, thereby supplying electric current through the controller 22 to recharge the storage device 24 at step 60. The rotation of the roll 14 and generation of the electric current terminates when the person tears off the extracted material, completing a dispensing cycle at step 62. Thereafter the operation returns to the idle mode at step 50.

If a user is found to be present at step 52, the operation advances directly to step 56 where a short length of the material is dispensed for the user to grasp. The person at step 58 grasps that portion and pulls an additional amount out of the dispenser to provide a sufficient length of towel for use. This extraction of the towel rotates the roll 14 which drives the motor 20 as a generator, thereby supplying electric current through the controller 22 to recharge the storage device 24.

Figure 5:
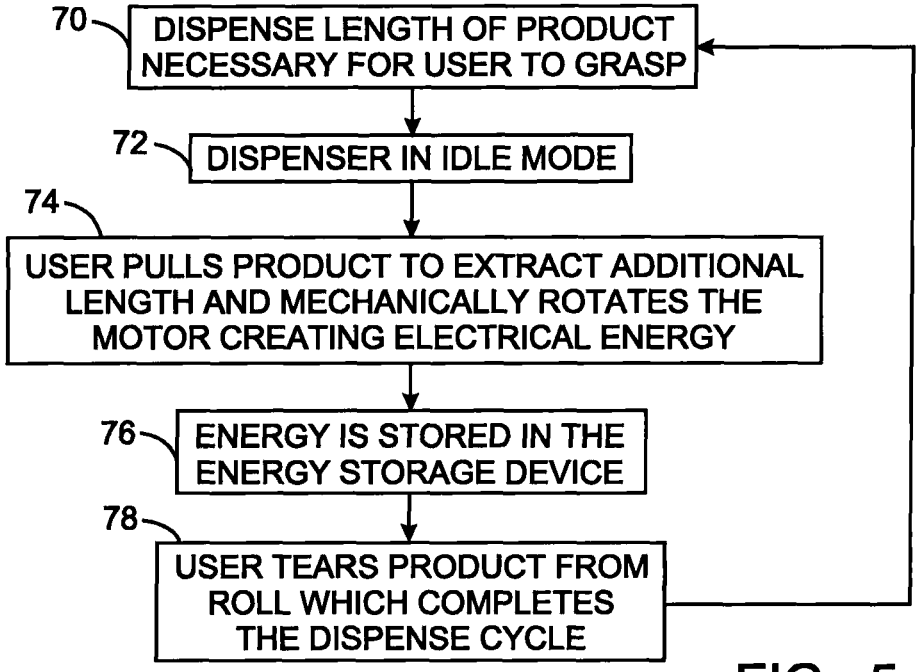
FIG. 5 is a flowchart of operation of a dispenser which does not employ an activator, such as a user proximity sensor.

With reference to FIG. 5, the present energy recovery technique also can be used by a dispenser that does not utilize an activator 26, such as a user proximity sensor. For this application, the dispensing process commences at step 70 at which the controller momentarily activates the motor 20 to dispense a short length of the material which is sufficient to be grasped by a user's hands. With that length of material projecting from the outlet 18 in the housing 12, the dispenser enters the idle state at step 72. When a user comes along and pulls additional material from the dispenser at step 74, the roll 14 rotates which mechanically drives the motor 20 due to the pulley and belt coupling. This action causes the motor 20 to act as an electrical generator, producing an electric current that is used to recharge the power storage device 24 at step 76. The user then tears the dispensed material from the dispenser at step 78. The controller 22 and specifically the processor 28 detects the rotation of the motor due to the user pulling the material through the outlet 18. After a short delay, the controller 22 again activates the motor at step 70 to dispense another short length of the material before entering the idle state to await another user pulling more material from the dispenser. In this embodiment, a short length of the material always projects from the dispenser for a user to grasp.

Figure 6:
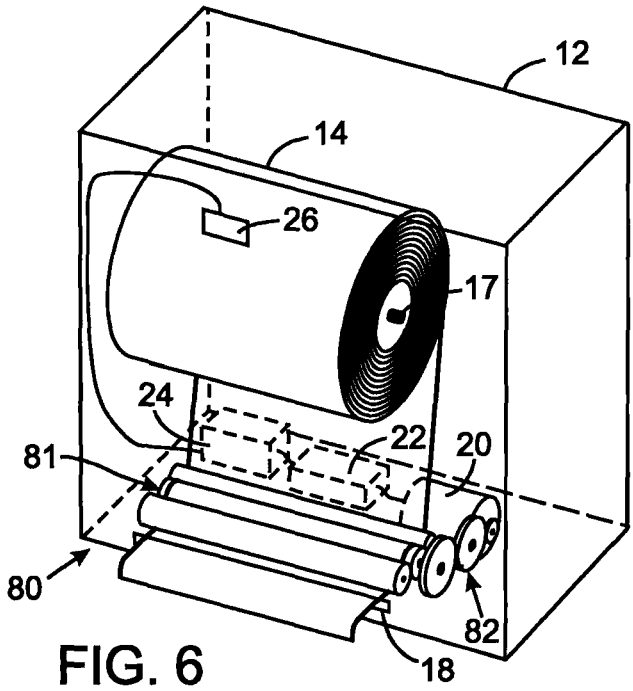
FIG. 6 illustrates a dispenser for a roll material that has a gear drive mechanism coupling the motor to a nip roller arrangement.

FIG. 6 depicts a dispenser 80 in which the material is drawn from the roll 14 by a nip roller arrangement 81 comprising a series of two abutting rollers and an additional roller in close proximity through which the material from the roll 14 passes in a serpentine manner. One of the rollers is connected to a gear driver 82 the couples the nip roller arrangement 81 to the electric motor 20. Thus when the motor is activated, the rollers rotate and the draw the material from the roll 14 and feed the material through the outlet 18.

Figure 7:
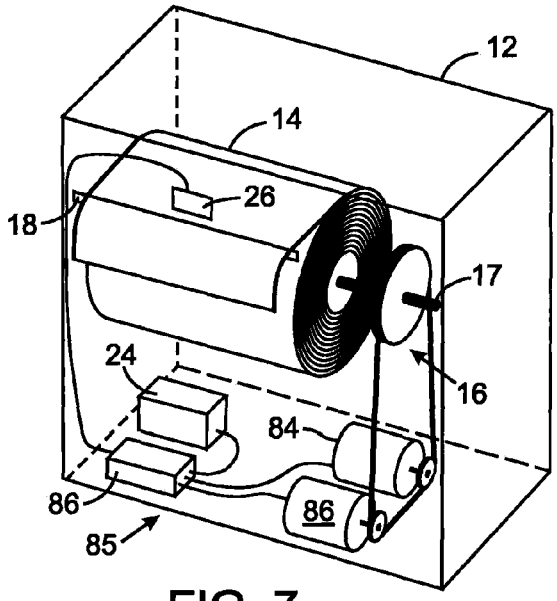
FIG. 7 illustrates a material dispenser that has an electrical generator which is separate from the motor.
Figure 8:
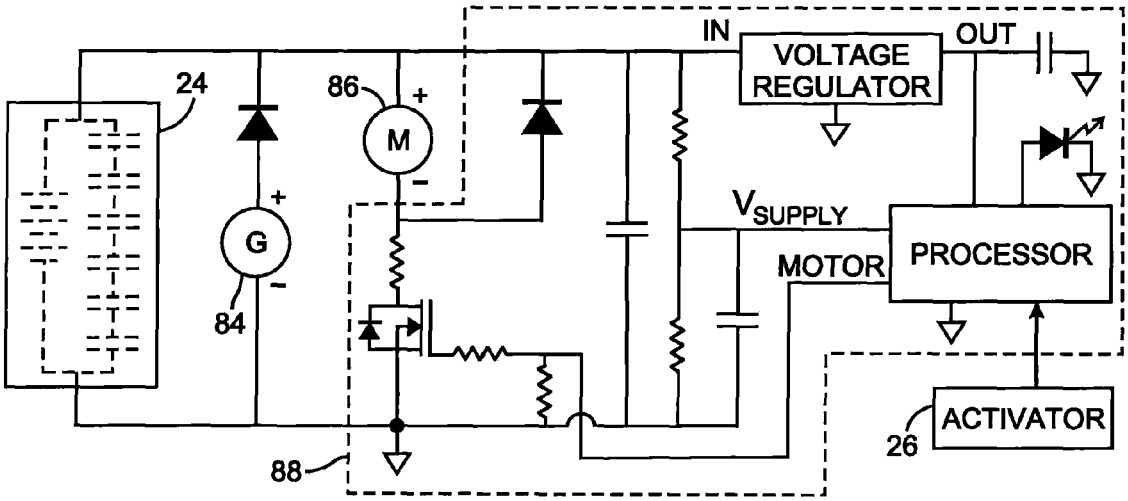
FIG. 8 is a schematic diagram of the electrical circuit for the dispenser in FIG. 7.

With reference to FIG. 7, the dispenser 85 has a generator or an alternator 84, which is separate from the motor 86, to generate the electricity for recharging the power storage device 24. This dispenser 85 utilizes a slightly different controller 88 the details of which are shown in FIG. 8. The remainder of the dispenser components are the same as in FIG. 1 and have been assigned identical reference numerals.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A method for operating an apparatus that dispenses material from a roll which is rotationally supported in a housing, said method comprising:

providing an electrical energy storage device;

applying electrical current from the electrical energy storage device to an electrically activated driver, thereby causing an amount of material to be drawn from the roll and dispensed through an outlet;

using motion, produced by a person pulling on the amount of material to extract additional material through the outlet, to generate electricity;

applying the electricity to charge the electrical energy storage device;

detecting an amount of energy contained in the electrical energy storage device; and in response to amount of energy contained in the electrical energy storage device being less than a predefined amount, activating the electrically activated driver to feed some of the material from the roll through the outlet of the housing.

2. The method as recited in claim 1 further comprising producing a signal designating a desire to dispense material from the roll; and wherein applying electrical current from the electrical energy storage device to an electrically activated driver is in response to the signal.

3. The method as recited in claim 2 wherein producing the signal designating a desire to dispense material from the roll comprises detecting presence of a person proximate the apparatus.

4. The method as recited in claim 1 wherein applying electrical current comprises applying electrical current to a motor.

5. The method as recited in claim 4 wherein using motion to generate electricity comprises applying motion produced by a person pulling on the amount of material to drive the motor thereby causing the motor to act as an electric generator.

6. The method as recited in claim 4 wherein using motion to generate electricity comprises applying motion produced by a person pulling on the amount of material to drive one of a generator and an alternator.

7. The method as recited in claim 1 wherein the electrical energy storage device is selected from the group consisting of a rechargeable battery and a capacitor.

8. An apparatus for dispensing material from a roll to a person, said apparatus comprising:

a housing having a support for the roll and having an outlet through which the material passes from the roll;

an electrically activated driver for drawing the material from the roll and feeding the material through the outlet;

a generator of electric current that is driven when the person pulls the material from the roll and through the outlet;

an electrical energy storage device;

a sensor for detecting an amount of energy contained in the electrical energy storage device; and a controller that responds to amount of energy contained in the electrical energy storage device being less than a predefined amount by operating the electrically activated driver to feed some of the material from the roll through the outlet of the housing;

wherein the apparatus has a first mode in which electrical current from the electrical energy storage device is applied to operate the electrically activated driver and feed an amount of material from the roll through the outlet of the housing, and has a second mode in which the person pulling additional material from the roll drives the generator thereby producing electricity that recharges the electrical energy storage device.

9. The apparatus as recited in claim 8 further comprising an activator that provides a signal indicating when material should be dispensed from the roll, wherein the electrical current is applied to operate the electrically activated driver in response to the activator.

10. The apparatus as recited in claim 9 wherein the activator is a sensor that detects presence of a person proximate the apparatus.

11. The apparatus as recited in claim 9 wherein the activator is an infrared proximity sensor that detects presence of a person proximate the apparatus.

12. An apparatus for dispensing material from a roll to a person, said apparatus comprising:

a housing having a support for the roll and having an outlet through which the material passes from the roll;

an electric motor operably coupled to draw the material from the roll and feed the material through the outlet;

an electrical energy storage device; and a sensor for detecting an amount of energy contained in the electrical energy storage device; and a controller that responds to amount of energy contained in the electrical energy storage device being less than a predefined amount by operating the electric motor to feed some of the material from the roll through the outlet of the housing;

wherein the apparatus has a first mode in which an electrical current from the electrical energy storage device is applied to the electric motor thereby causing an amount of material to be fed from the roll through the outlet of the housing, and has a second mode in which the person pulling additional material from the roll drives the motor which acts as a generator producing electricity that recharges the electrical energy storage device.

13. The apparatus as recited in claim 12 further comprising an activator that provides a signal indicating when material should be dispensed from the roll, wherein the electrical current from the electrical energy storage device is applied to operate the electric motor in response to the activator.

14. The apparatus as recited in claim 13 wherein the activator is a sensor that detects presence of a person proximate the apparatus.

* * * * *